US010031439B2

(12) United States Patent
Agata et al.

(10) Patent No.: US 10,031,439 B2
(45) Date of Patent: Jul. 24, 2018

(54) DEVELOPING DEVICE HAVING DEVELOPER REGULATING MEMBER, PROCESS CARTRIDGE, AND IMAGE FORMING APPARATUS

(71) Applicant: CANON KABUSHIKI KAISHA, Tokyo (JP)

(72) Inventors: Shinichi Agata, Suntou-gun (JP); Takayoshi Kihara, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/468,381

(22) Filed: Mar. 24, 2017

(65) Prior Publication Data

US 2017/0285515 A1 Oct. 5, 2017

(30) Foreign Application Priority Data

Mar. 30, 2016 (JP) ..... 2016-069388

(51) Int. Cl.
*G03G 15/08* (2006.01)
*G03G 15/06* (2006.01)

(52) U.S. Cl.
CPC ..... *G03G 15/0812* (2013.01); *G03G 15/065* (2013.01)

(58) Field of Classification Search
CPC ..... G03G 15/0812; G03G 15/065
USPC ..... 399/284
See application file for complete search history.

(56) References Cited

U.S. PATENT DOCUMENTS 5,473,417 A * 12/1995 Hirano ..... G03G 15/0806 399/285
7,457,554 B2 11/2008 Matsuda et al.
7,711,279 B2 5/2010 Matsuda et al.
2007/0110482 A1* 5/2007 Kazaki ..... G03G 15/0812 399/279
2011/0158707 A1 6/2011 Agata
2015/0253691 A1* 9/2015 Mitsui ..... G03G 15/0812 399/55
2015/0261131 A1* 9/2015 Maeshima ..... G03G 15/0831 399/27
2017/0285526 A1* 10/2017 Seki ..... G03G 15/0881

FOREIGN PATENT DOCUMENTS

JP H11-272067 A 10/1999

* cited by examiner

*Primary Examiner* — Quana M Grainger
(74) *Attorney, Agent, or Firm* — Fitzpatrick, Cella, Harper & Scinto

(57) ABSTRACT

A developing blade has a protrusion that protrudes toward a developing roller in an opposing portion facing the developing roller. The potential difference between a supply bias and a developing bias is denoted by Δ(V), a contact pressure of the developing blade with respect to the developing roller is denoted by X (gf/cm), a height of the protrusion from the opposing surface that faces the developing roller at a position further toward a tip side than the protrusion is denoted by H (mm), and a length of the opposing surface in the rotation direction of the developing roller is denoted by L (mm). When viewing a cross-section perpendicular to the rotation axis of the developing roller, $0.05 \leq H \leq 0.1$, $0.15 \leq L \leq 1.0$, and $15 \leq X \leq 60$ are established, and at least $\Delta \geq -5*X-125$ is satisfied.

21 Claims, 5 Drawing Sheets

DEVELOPING DEVICE HAVING DEVELOPER REGULATING MEMBER, PROCESS CARTRIDGE, AND IMAGE FORMING APPARATUS

BACKGROUND OF THE INVENTION

Field of the Invention

The present invention relates to a developing device for use in an electrophotographic image forming apparatus.

Description of the Related Art

A known developing device for visualizing an electrostatic latent image by using a mono-component toner is equipped with a developing roller as a developer carrying member that carries and transports a toner, and a supply roller as a developer supply member that is disposed on the periphery of the developing roller and supplies the toner to the developing roller. In such a developing device, the toner is supplied to the developing roller, while being triboelectrically charged by mechanical rubbing between the supply roller and the developing roller. After the thickness of the toner layer on the developing roller has been regulated to a certain amount by a developing blade, which is a developer regulating member, the supplied toner is transported to a developing zone, which is close to a photosensitive drum serving as an image bearing member, and the electrostatic latent image is visualized as a toner image. The toner which has not been used for the development in the developing zone and remains on the developing roller is scraped off by mechanical rubbing from the developing roller in the contact region with the supply roller. At the same time, the toner is supplied from the supply roller to the developing roller.

Here, the surface of the developing roller and the surface of the supply roller are disposed so that they have a relative circumferential speed ratio that ensures both the toner supply amount and the scraping performance of the undeveloped toner. Thus, the respective rotational speeds are controlled such that the supply roller moves faster than the developing roller in the contact region of the developing roller and the supply roller. Further, the amount of the toner supplied from the supply roller to the developing roller can be adjusted by adjusting the potential difference between the bias (supply bias) applied to the supply roller and the bias (developing bias) supplied to the developing roller.

In the conventional developing device, in order to regulate the thickness of the toner layer to a certain amount, the following configuration has been suggested for a developing blade that extends in a direction opposite to the rotation direction of the developing roller from one end, which is fixed to a frame main body, and is in contact with the developing roller surface at the other end side. Thus, the developing blade is provided, in the opposing portion facing the developing roller at the tip portion of the other end of the developing blade, with a step-like shape having a pressure contact surface which is in pressure contact with the developing roller and an opposing surface formed such as to face the developing roller, at a distance therefrom, on the upstream side (tip side) in the rotation direction of the developing roller, of the pressure contact surface (Japanese Patent Application Publication No. H11-272067). With such a configuration, a toner storing container is formed more stably in the opposing portion on the upstream side of the step in the rotation direction of the developing roller. Therefore, the toner pressure immediately before the layer regulation is made uniform and a uniform toner layer can be stably obtained.

However, with the developing blade of the abovementioned configuration, where the potential difference between the supply bias and developing bias increases at a certain threshold or above the threshold, the so-called dripping effect occurs, that is, the toner which has been transported without being regulated by the developing blade is accumulated between the developing blade and the developing roller. This problem occurs because the toner supply capability of the supply roller exceeds the regulating force of the developing blade. The toner dripping is a state in which the toner is not held on the developing roller and falls on the developing blade downstream of the toner regulating portion of the developing roller. Where image formation is continued in this state, contamination advances to the interior of an image forming body and a recording material, thereby causing the deterioration of image quality.

SUMMARY OF THE INVENTION

The developing device according to the present invention is a developing device for use in an image forming apparatus, the developing device comprising:

a frame that accommodates a developer;

a developer carrying member that is rotatably provided in an opening of the frame and carries and transports the developer;

a supply member that supplies the developer to the developer carrying member, the supply member being in contact with the developer carrying member and being provided rotatably so as to move in the same direction with respect to the rotating developer carrying member at a contact region thereof;

a regulating member that is blade-shaped, one end of the regulating member being fixed to the frame, and the other end of the regulating member, which is a free end extending in a direction opposite to a rotation direction of the developer carrying member, being in contact with the developer carrying member;

a developing bias application portion for applying a developing bias to the developer carrying member; and a supply bias application portion for applying a supply bias to the supply member, wherein the regulating member comprising, an opposing portion that faces the developer carrying member, and a protrusion that protrudes toward the developer carrying member in the opposing portion;

wherein the opposing portion comprising an opposing surface that faces the developer carrying member at a position further toward a tip side of the other end than the protrusion at the opposing portion, and wherein, when a potential difference between the supply bias and the developing bias, which is obtained by subtracting the developing bias from the supply bias, is denoted by $\Delta(V)$, a contact pressure of the regulating member with respect to the developer carrying member is denoted by X (gf/cm), and a height of the protrusion from the opposing surface is denoted by H (mm) and a length of the opposing surface in the rotation direction of the developer carrying member is denoted by L (mm), when viewing a cross section perpendicular to a rotation axis of the developer carrying member, $0.05 \leq H \leq 0.1$, $0.15 \leq L \leq 1.0$, and $15 \leq X \leq 60$ are established, and at least the following relationship is satisfied:

$$\Delta \geq -5*X-125.$$

The developing device according another aspect of the present invention is a developing device for use in an image forming apparatus, the developing device comprising:

a frame that accommodates a developer;

a developer carrying member that is rotatably provided in an opening of the frame and carries and transports the developer;

a supply member that supplies the developer to the developer carrying member, the supply member being in contact with the developer carrying member and being provided rotatably so as to move in the same direction with respect to the rotating developer carrying member at a contact region thereof;

a regulating member that is blade-shaped, one end of the regulating member being fixed to the frame, and the other end of the regulating member, which is a free end extending in a direction opposite to a rotation direction of the developer carrying member, being in contact with the developer carrying member;

a developing bias application portion for applying a developing bias to the developer carrying member; and a supply bias application portion for applying a supply bias to the supply member, wherein the regulating member comprising;

an opposing portion that faces the developer carrying member, and a protrusion that is provided on the opposing portion away from a tip of the other end, and protrudes toward the developer carrying member; and wherein a potential difference between the supply bias and the developing bias, which is obtained by subtracting the developing bias from the supply bias, is denoted by $\Delta$(V), at least the following relationship is satisfied:

$$\Delta \geq -200.$$

The developing device according still another aspect of the present invention is a developing device for use in an image forming apparatus, the developing device comprising:

a frame that accommodates a developer;

a developer carrying member that is rotatably provided in an opening of the frame and carries and transports the developer;

a supply member that supplies the developer to the developer carrying member, the supply member being in contact with the developer carrying member and being provided rotatably so as to move in the same direction with respect to the rotating developer carrying member at a contact region thereof;

a regulating member that is blade-shaped, one end of the regulating member being fixed to the frame, and the other end of the regulating member, which is a free end extending in a direction opposite to a rotation direction of the developer carrying member, being in contact with the developer carrying member;

a developing bias application portion for applying a developing bias to the developer carrying member; and a supply bias application portion for applying a supply bias to the supply member, wherein the regulating member comprising, an opposing portion that faces the developer carrying member, and a protrusion that protrudes toward the developer carrying member in the opposing portion;

wherein the opposing portion comprising an opposing surface that faces the developer carrying member at a position further toward a tip side of the other end than the protrusion at the opposing portion, and wherein a potential difference between the supply bias and the developing bias, which is obtained by subtracting the developing bias from the supply bias, is denoted by $\Delta$(V), a contact pressure of the regulating member with respect to the developer carrying member is denoted by X (gf/cm), and a height of the protrusion from the opposing surface is denoted by H (mm) and a length of the opposing surface in the rotation direction of the developer carrying member is denoted by L (mm), when viewing a cross section perpendicular to a rotation axis of the developer carrying member, $0.1 \leq H \leq 0.3$, $0.15 \leq L \leq 1.0$, and $15 \leq X \leq 60$ are established, and at least the following relationship is satisfied:

$$\Delta \geq -5*X-175.$$

The process cartridge according to the present invention is a process cartridge that can be detachably attached to an apparatus main body of an image forming apparatus, the process cartridge comprising:

the developing device; and an image bearing member on which a latent image that is to be developed by the developing device is formed.

Similarly, the image forming apparatus according to the present invention is an image forming apparatus that forms an image on a recording material, the image forming apparatus comprising:

the developing device; and an image bearing member on which a latent image that is to be developed by the developing device is formed, wherein a developer image which has been formed on the image bearing member by the development of the latent image is transferred to a recording material.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

<Image Forming Apparatus>

Figure 1:
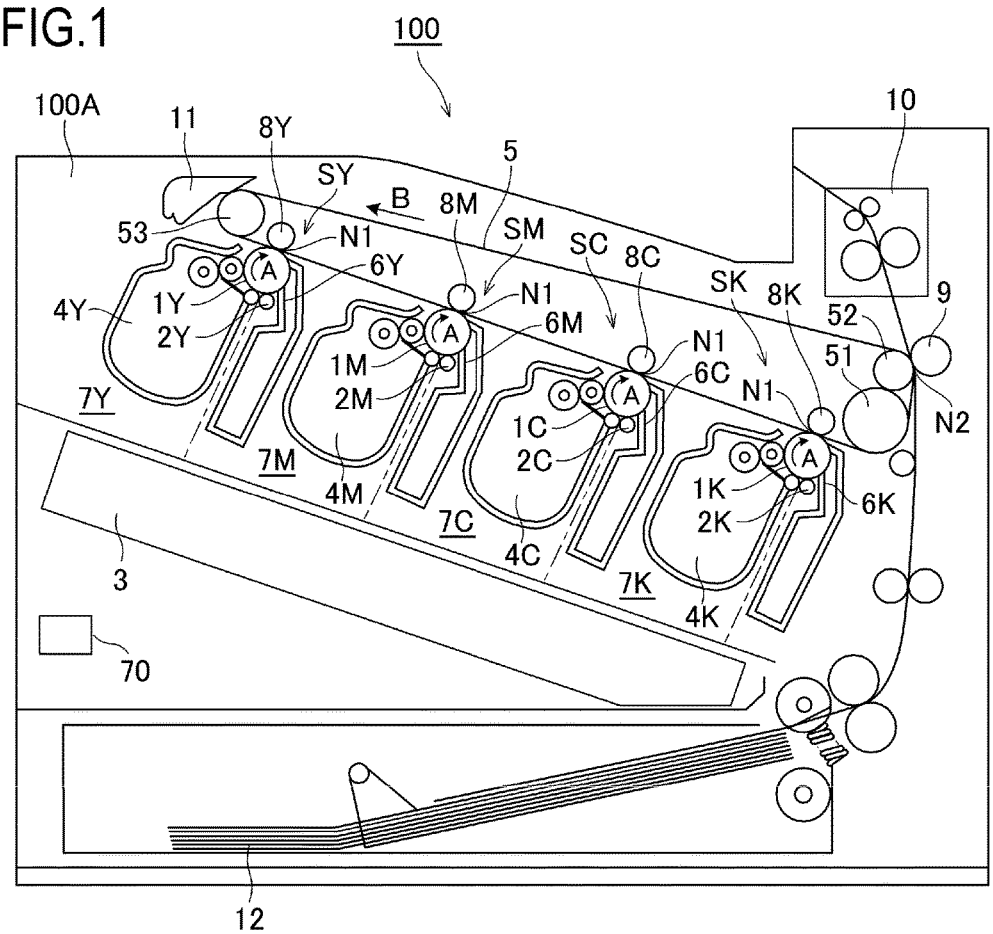
FIG. 1 is a schematic cross-sectional view of the image forming apparatus according to Example 1.

The overall configuration of the electrophotographic image forming apparatus (referred to hereinbelow as image forming apparatus) according to the examples of the present invention will be explained hereinbelow with reference to FIG. 1. FIG. 1 is a schematic cross-sectional view of an image forming apparatus 100 of the present example. The image forming apparatus 100 of the present example is a full-color laser printer using an inline system and an intermediate transfer system. The image forming apparatus 100 can form a full-color image on a recording material (for example, recording paper, plastic sheet, cloth, etc.) according to image information. The image information is inputted to an image forming apparatus main body 100A from an image reading device connected to the image forming apparatus main body 100A, or a host device such as a personal computer communicatively connected to the image forming apparatus main body 100A.

The image forming apparatus 100 has first, second, third and fourth image forming units SY, SM, SC, and SK for forming images for yellow (Y), magenta (M), cyan (C), and black (K) colors, respectively, as a plurality of image forming units. The first to fourth image forming units SY, SM, SC, and SK are disposed in a row in the direction intersecting the vertical direction. In the present example, the first to fourth image forming units SY, SM, SC, and SK have substantially the same configuration and operation, except for the color of the image to be formed. Therefore, in the following general description, the suffixes Y, M, C, and K assigned to the reference for indicating that an element is provided for a specific color are omitted unless special distinction is required.

In the present example, the image forming apparatus 100 has four drum-type electrophotographic photosensitive members, that is, photosensitive drums 1, as a plurality of image bearing members disposed side by side in the direction intersecting the vertical direction. The photosensitive drums 1 are rotationally driven by driving means (driving sources; not shown in the drawings) in the direction shown by an arrow A in the drawing (clockwise direction). A charging roller 2 as charging means for uniformly charging the surface of the photosensitive drum 1 and a scanner unit (exposure device) 3 as exposure means for forming an electrostatic image (electrostatic latent image) on the photosensitive drum 1 by laser irradiation according to image information are disposed on the periphery of the photosensitive drum 1. A developing unit (developing device) 4 as developing means for developing the electrostatic image as a toner image (developer image), and a cleaning member 6 as cleaning means for removing the untransferred toner remaining on the surface of the photosensitive drum 1 after the transfer are also disposed on the periphery of the photosensitive drum 1. An intermediate transfer belt 5 as an intermediate transfer member for transferring the toner image on the photosensitive drums 1 to a recording material 12 is disposed above the photosensitive drums 1 so as to face the four photosensitive drums 1.

In the present example, the developing unit 4 serving as a developing device uses a nonmagnetic mono-component developer. Further, in the developing unit 4 of the present example, the developing roller serving as a developer bearing member is brought into contact with the photosensitive drum 1 to perform reverse development. Thus, in the present example, the developing unit 4 develops the electrostatic image by causing the toner, which has been charged to the same polarity (negative polarity in the present example) as the charge polarity of the photosensitive drum 1, to adhere to the region (image region, exposure region) on the photosensitive drum 1 where the charge has been reduced by exposure.

In the present example, the photosensitive drum 1 and the charging roller 2, the developing unit 4, and the cleaning member 6 as process means acting upon the photosensitive drum 1 are integrated. Thus, those components are integrated as a cartridge and form a process cartridge 7. The process cartridge 7 can be detachably attached to the image forming apparatus 100 through mounting means such as a mounting guide or a positioning member provided on the image forming apparatus main body 100A. In the present example, the process cartridges 7 of all colors have the same shape, and the toners of yellow (Y), magenta (M), cyan (C), and black (K) colors are accommodated in the process cartridges 7 of respective colors. Further, in the present example, nonmagnetic mono-component toners are used as the developers.

The intermediate transfer belt 5 formed by an endless belt and serving as an intermediate transfer member is in contact with all of the photosensitive drums 1 and circulatory moves (rotates) in the direction shown by an arrow B in the drawing (counterclockwise direction). The intermediate transfer belt 5 is stretched over a drive roller 51, a secondary transfer opposing roller 52, and a driven roller 53 as a plurality of support means. Four primary transfer rollers 8, as primary transfer means, are disposed side by side on the inner peripheral surface side of the intermediate transfer belt 5 so as to face the photosensitive drums 1. The primary transfer roller 8 presses the intermediate transfer belt 5 against the photosensitive drum 1 and forms a primary transfer portion N1 in which the intermediate transfer belt 5 and the photosensitive drum 1 are in contact with each other. Then, a bias of a polarity opposite to the regular charge polarity of the toner is applied to the primary transfer roller 8 from the primary transfer bias power source (high-voltage power source) as primary transfer bias application portion (not shown in the drawing). As a result, the toner image on the photosensitive drum 1 is transferred (primary transfer) onto the intermediate transfer belt 5.

Further, a secondary transfer roller 9 is disposed as secondary transfer means at a position facing the secondary transfer opposing roller 52 on the outer peripheral surface side of the intermediate transfer belt 5. The secondary transfer roller 9 is pressed into contact with the secondary transfer opposing roller 52, with the intermediate transfer belt 5 being interposed therebetween, and forms a secondary transfer portion N2 where the intermediate transfer belt 5 and the secondary transfer roller 9 are in contact with each other. Then, a bias of a polarity opposite to the regular charge polarity of the toner is applied to the secondary transfer roller 9 from the secondary transfer bias power source (high-voltage power source) as secondary transfer bias application portion (not shown in the drawing). As a result, the toner image on the intermediate transfer belt 5 is transferred (secondary transfer) onto the recording material 12.

For example, when a full-color image is formed, the process up to and including the aforementioned primary transfer is sequentially performed in the first to fourth image forming units SY, SM, SC, and SK, and toner images of each color are successively primary transferred in superposition on the intermediate transfer belt 5. The recording material 12 is thereafter transported to the secondary transfer portion N2 synchronously with the movement of the intermediate transfer belt 5. The four-color toner image on the intermediate transfer belt 5 is secondary transferred as a whole onto the recording material 12 by the action of the secondary transfer roller 9 which is in contact with the intermediate transfer belt 5, with the recording material 12 being interposed therebetween. The recording material 12 onto which the toner image has been transferred is transported to the fixing device 10 as fixing means. The toner image is fixed to the recording material 12 by application of heat and pressure to the recording material 12 in the fixing device 10.

The primary untransferred toner remaining on the photosensitive drum 1 after the primary transfer step is removed and recovered by the cleaning member 6. The secondary untransferred toner remaining on the intermediate transfer belt 5 after the secondary transfer step is cleaned by an intermediate transfer belt cleaning device 11. It should be noted that the image forming apparatus 100 can form monochrome or multi-color images using only one desired image forming unit or only some (not all) image forming units.

<Process Cartridge>

Figure 2:
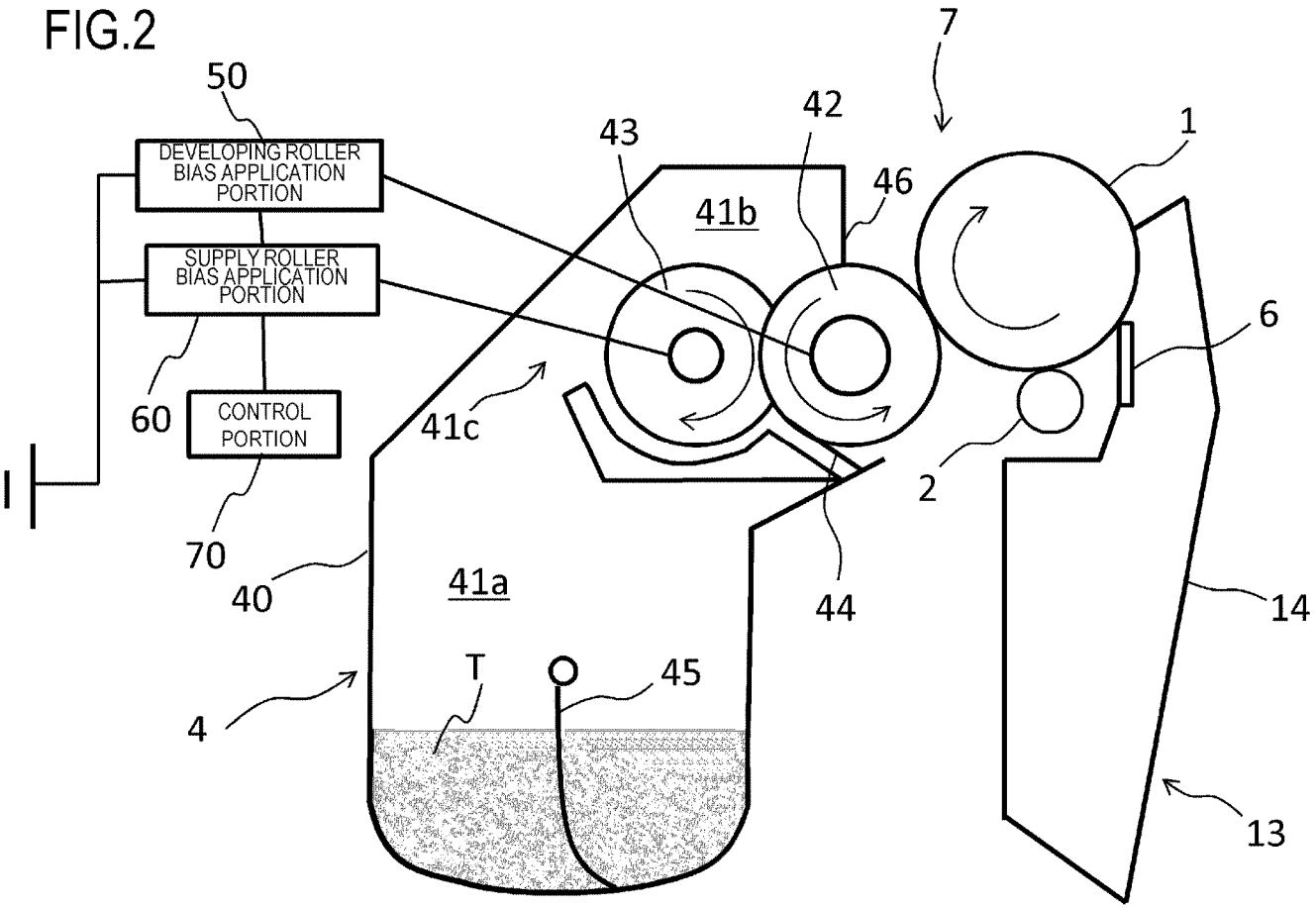
FIG. 2 is a schematic cross-sectional view of the developing device according to Example 1.

The overall configuration of the process cartridge 7 which is mounted on the image forming apparatus 100 of the present example will be explained hereinbelow with reference to FIG. 2. In the present example, the process cartridges 7 of each color have substantially the same configuration and operation, except for the type (color) of the toner accommodated therein. FIG. 2 is a schematic cross-sectional (main cross-sectional) view of the process cartridge 7 of the present example, which is viewed along the longitudinal direction (rotation axis direction) of the photosensitive drum 1. The posture of the process cartridge 7 in FIG. 2 is that after mounting on the image forming apparatus main body. Where mutual arrangement and orientation and the like of members of the process cartridge are described hereinbelow, those mutual arrangement and orientation and the like are assumed to relate to this posture.

The process cartridge 7 is configured by integrating a photosensitive member unit 13 including the photosensitive drum 1 or the like, and the developing unit 4 including the developing roller 42 or the like. The photosensitive member unit 13 has a cleaning frame 14 serving as a frame that supports various elements inside the photosensitive member unit 13. The photosensitive drum 1 is rotatably attached through a bearing (not shown in the drawing) to the cleaning frame 14. The photosensitive drum 1 is rotationally driven in the direction shown by the arrow A in the drawing (clockwise direction) in response to the image forming operation by transmitting the driving force of a driving motor serving as driving means (driving source; not shown in the drawing) to the photosensitive member unit 13. In the present example, the photosensitive drum 1, which is the principal component of the image forming process uses the organic photosensitive drum 1 in which an undercoat layer which is a functional film, a carrier generating layer, and a carrier transfer layer are sequentially coated on the outer peripheral surface of an aluminum cylinder.

Further, in the photosensitive member unit 13, the cleaning member 6 and the charging roller 2 are disposed so as to be in contact with the peripheral surface of the photosensitive drum 1. The untransferred toner removed from the surface of the photosensitive drum 1 by the cleaning member 6 falls down and is accommodated in the cleaning frame 14. The charging roller 2 serving as charging means is driven to rotate by pressing a roller portion made from an electrically conductive rubber into contact with the photosensitive drum 1. Here, a predetermined DC voltage with respect to the photosensitive drum 1 is applied to the core of the charging roller 2 as a charging step. As a result, a uniform dark potential (Vd) is formed on the surface of the photosensitive drum 1. A spot pattern of a laser beam emitted correspondingly to the image data by a laser from the aforementioned scanner unit 3 exposes the photosensitive drum 1, electric charges on the surface in the exposed segment are eliminated by the carriers from the carrier generating layer, and the electric potential decreases. As a result, an electrostatic latent image with a predetermined light potential (Vl) at the exposed segment and a predetermined dark potential (Vd) at the unexposed segment is formed on the photosensitive drum 1. In the present example, Vd=−500 V and Vl=−100 V.

<Developing Unit (Developing Device)>

The developing unit 4 is provided with the developing roller 42 as a developer carrying member that carries a toner T, a toner supply roller 43 as a supply member that supplies the toner to the developing roller 42, and an agitator 45 as a developer transport member that transports the toner T to the toner supply roller 43. The developing unit 4 includes a developing container 40 as a frame to which the developing roller 42, the toner supply roller 43, and the agitator 45 are rotatably assembled. The developing container 40 has a toner accommodating chamber 41*a* where the agitator 45 is disposed, a developing chamber 41*b* where the developing roller 42 and the toner supply roller 43 are disposed, and a communication port 41*c* that links the toner accommodating chamber 41*a* and the developing chamber 41*b* so as to enable the movement of the toner T. The developing chamber 41*b* is provided with an opening for carrying the toner to the outside of the developing container 40, and the developing roller 42 is rotatably assembled to the developing container 40 in such a manner as to close the opening. Part of the peripheral surface of the developing roller 42 is exposed to the outside from the opening.

The toner T accommodated inside the toner accommodating chamber 41*a* is lifted by the agitator 45 to the developing chamber 41*b* where the developing roller 42 is disposed. The lifted toner T is stored on the upper side, in the gravity direction, of the contact region between the developing roller 42 and the supply roller 43 and mechanically rubbed at the contact region between the supply roller 43 and the developing roller 42 as the supply roller 43 rotates. The toner is triboelectrically charged by the rubbing and is carried and supplied onto the developing roller 42. The toner T carried on the rotating developing roller 42 passes through the opening and moves to the outside of the developing container 40 and is used for developing the electrostatic latent image on the photosensitive drum 1. At that time, the amount of toner carried to the outside of the developing container 40 is regulated and adjusted by the developing blade 44. Thus, the thickness of the toner layer carried on the developing roller 42 is reduced to an appropriate value by the developing blade 44 that is in contact with the developing roller 42, with the toner being interposed therebetween. At the same time, the toner supplied to the developing roller 42 is squeezed between the developing roller 42 and the developing blade 44. As a result, the toner is brought and rubbed between the surface of the developing roller 42 and the surface of the developing blade 44 and is triboelectrically charged to a desired polarity. The toner is then transported to the developing zone, which is the opposing portion facing the photosensitive drum 1, by the rotation of the developing roller 42 in the direction of the arrow.

In the developing zone, the toner layer on the developing roller 42 is used to develop the electrostatic latent image on the photosensitive drum 1 by a developing electric field generated by developing roller bias application portion 50, and the electrostatic latent image is visualized as a toner image. The toner which is not used for the development in the developing zone and remains on the developing roller 42 is rubbed and mixed in the portion that is in contact with the supply roller 43. At the same time, the developer is newly supplied onto the developing roller 42 by the rotation of the supply roller 43. Meanwhile, the undeveloped toner which has been rubbed and mixed by the supply roller 43 is returned by the rotation of the supply roller 43 into the toner accommodating chamber 41*a*, which is located therebelow, and stirred and mixed with another toner in the toner accommodating chamber 41*a* by the rotation of the agitator 45.

A blowing preventing sheet 46 for preventing toner leakage is provided on the side of the opening of the developing container 40 which is opposite to the side where the developing blade 44 is disposed. The toner accommodating chamber 41*a* is positioned below the developing chamber 41*b* in the gravity direction. The position at which the developing blade 44 is in contact with the developing roller 42 is below the rotation center of the developing roller 42 and is between the rotation center of the developing roller 42 and the rotation center of the toner supply roller 43 in the horizontal direction. In the present example, a nonmagnetic mono-component toner is used as the toner T.

Detail conditions relating to each part of the developing unit 4 according to the present example will be described hereinbelow. In the present example, a nonmagnetic mono-component negative charged toner is used as the toner. Further, in the present example, a toner having a percent cohesion of 5% to 40% in the initial state is used. By using the toner having such a degree of agglomeration, it is possible to ensure toner fluidity through the entire service life of the toner. The degree of agglomeration of the toner was measured in the following manner. A powder tester (manufactured by Hosokawa Micron Corporation) having a digital vibration meter (Digital Vibration Meter Model 1332, manufactured by Showa Sokki Corporation) was used as a measuring device. As a measuring method, 390-mesh, 200-mesh, and 100-mesh sieves were set on the vibration table in the order of reducing aperture mesh size, that is, the 390-mesh, 200-mesh, and 100-mesh sieves were set in the order of description so that the 100-mesh sieve was at the top. A total of 5 g of accurately weighed sample (toner) was placed on the 100-mesh sieve, which has thus been set, the displacement value of the digital vibration meter was adjusted to be 0.60 mm (peak-to-peak), and vibrations were induced for 15 s. The mass of the sample remaining on each sieve was then measured to obtain the percent cohesion on the basis of the following formula. The measurement samples at this time were each allowed to stand in advance for 24 h under the environment of 23° C. and 60% RH, and the measurements were conducted under the environment of 23° C. and 60% RH.

Percent cohesion (%)=(residual sample mass on 100-mesh sieve/5 g)×100+(residual sample mass on 200-mesh sieve/5 g)×60+(residual sample mass on 390-mesh sieve/5 g)×20.

In the supply roller 43 which has a diameter of 15 mm, flexible foamed polyurethane was formed on an electrically conductive metal core with a diameter of 6 mm. The surface hardness can be 50° to 80°, as measured by Asker-F durometer. The supply roller is disposed to have a penetration amount of 1.0 mm with respect to the developing roller 42. A bias (supply bias) is supplied to the supply roller 43 from a supply roller bias power source (high-voltage power source) 60 as supply bias application portion.

In the developing roller 42, which has a diameter of 12 mm, a silicone rubber is formed as a base layer on an electrically conductive metal core with a diameter of 6 mm and a urethane rubber is formed as a surface layer on the base layer. The developing roller 42 with a volume resistance of 10E4Ω to 10E12Ω can be used. The surface hardness can be within a range of 30° to 75°, as measured by Asker-C durometer. Further, the rotation speed of the developing roller is 200 rpm. A bias (developing bias) which is sufficient for developing and visualizing the electrostatic latent image on the photosensitive drum 1 as a toner image is applied from the developing roller bias power source (high-voltage power source) 50 as developing bias application portion to the developing roller 42.

The supply roller 43 is rotationally driven in a direction opposite to that of the developing roller 42, that is, so that the surfaces of the two rollers 42, 43 move in the forward direction at the contact region thereof. The ratio of the surface peripheral speed VSP of the supply roller 43 to the surface peripheral speed VDR of the developing roller 42, that is, VSP/VDR, is set to 160%. Further, the toner amount supplied to the developing roller 42 can be adjusted by adjusting the potential difference between the supply bias applied to the supply roller 43 and the developing bias applied to the developing roller 42. The biases supplied by the developing roller bias power source (developing roller bias application portion) 50 and the supply roller bias power source (supply roller bias application portion) 60 are controlled by a control portion 70 which is configured by a CPU or a memory and controls various operations of the image forming apparatus. In the present example, the surfaces of the supply roller 43 and the developing roller 42 are rotationally driven so as to move in the forward direction at the contact region thereof, but they may be also rotationally driven in the counter direction at the contact region, provided that the toner supply and the scraping performance of the undeveloped toner are both satisfactory.

<Developing Blade Configuration which is the Specific Feature of the Present Example>

The developing blade 44, which is the specific feature of the present example, will be explained hereinbelow with reference to FIGS. 3A and 3B. The developing blade 44 comes into contact with the developing roller 42 to optimize the amount of the toner on the developing roller 42 and to optimizing the charge of the toner. Here, the contact pressure of the developing blade 44 with respect to the developing roller 42 is preferably 15 gf/cm to 60 gf/cm. Where the contact pressure is lower than 15 gf/cm, the rubbing force between the developing blade 44 and the developing roller 42 decreases, the triboelectric charging ability of the toner is weakened, and the toner that has passed by the developing roller 42 is scattered. Further, where the contact pressure is higher than 60 gf/cm, the pressure between the developing blade 44 and the developing roller 42 becomes too high, thereby advancing the deterioration of the toner. Where toner deterioration, that is, the release and embedment of an external additive on the toner surface, is advanced, the cohesion is increased and the toner charging performance is lowered, problems such as toner filming in which the toner fuses on the developing roller occur, and the service life of the toner is shortened.

A method for measuring the pressure of the developing blade will be explained hereinbelow. The developing blade 44 is in surface contact with the outer peripheral surface of the developing roller 42. The contact pressure of the developing blade 44 is measured by mounting the developing unit 4 from which the developing roller 42 has been removed on a dedicated measuring jig and bringing the developing blade 44 into contact with an aluminum sleeve having the same diameter as the developing roller 42 and serving as a virtual developing roller. The aluminum sleeve is divided into five sections in the longitudinal direction, and the length of a gauge head is 50 mm. The contact pressure of the developing blade is calculated from the average value at the five measurement points.

Figure 3A:
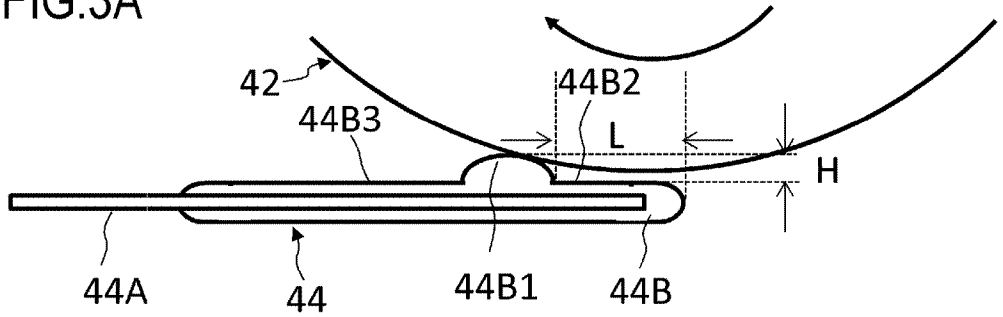
FIGS. 3A and 3B are schematic cross-sectional views of the developing blade in Example 1.

FIG. 3A is a schematic cross-sectional view for explaining the shape of the developing blade 44 in the present example. The developing blade 44 is a blade-shaped member having a support member 44A and a resin layer 44B integrally attached to the tip side of the support member 44A.

The support member 44A is a plate-shaped elastic member. A metal thin plate, namely, a stainless steel thin plate, was used to impart elasticity (springiness) to the support member 44A. However, in addition to stainless steel, phosphor bronze, an aluminum alloy, etc., may be also used. In the present example, a sheet metal with a width of 226 mm in the longitudinal direction, a width of 9.6 mm in the lateral direction perpendicular to the longitudinal direction, and a thickness of 0.08 mm is used as the support member 44A. One end portion, in the lateral direction, of the support member 44A is fixed, as a portion to be fixed, with a fastener such as a screw to a fixing portion provided on the developing chamber 41 of the developing container 40, and the other end portion of the support member is a free end in a cantilever. Thus, the one end portion of the support member 44A serves as a base end portion in the developing blade 44, and the other end portion of the support member 44A on which the resin layer 44B is formed becomes a tip portion of the developing blade 44 which is in sliding contact with the developing roller 42. The tip side of the support member 44A faces the upstream side in the rotation direction of the developing roller 42. Thus, the developing blade 44 is disposed to face the counter direction with respect to the rotation of the developing roller 42.

The resin layer 44B is formed so as to cover the other end portion of the support member 44A from the side of the surface (front surface side) of the support member 44A opposing the developing roller 42 to the back surface side through the tip of the other end portion. The resin layer 44B is fabricated by coating the support member 44A with polyurethane. In addition to the above, a polyamide, a polyamide elastomer, a polyester, a polyester elastomer, a polyester terephthalate, a silicone rubber, a silicone resin, and a melamine resin may be used individually or in combinations of two or more thereof for the material of the resin layer 44B. Various additives such as roughening particles can be contained, if necessary, in these materials. A metal may be also used for the coat layer.

Methods, other than the coating method used at this time, that can be used for forming the resin layer 44B can be generally divided into methods for directly forming (integrally forming) the resin layer on the support member 44A and methods for forming the resin layer 44B in advance and adhesively bonding this layer to the support member 44A. The methods for directly forming the resin layer 44B on the support member 44A include a method for extruding a raw material on the support member 44A and a method for coating a metal thin sheet by dipping, coating, spraying and the like. Further, methods for forming the resin layer 44B in advance include a method for cutting a sheet prepared from a raw material and a method for forming the resin layer 44B in a metal mold or the like.

The resin layer 44B has, at a predetermined distance from a tip (other end portion side of the support member 44A, upstream side in the rotation direction of the developing roller 42), a protrusion 44B1 that protrudes toward the developing roller 42 in an opposing portion facing the developing roller 42. An opposing portion 44B2 at a position further toward the tip side than the protrusion 44B1, that is, on the upstream side in the rotation direction of the developing roller 42, faces the developing roller 42 through a predetermined space. The side opposite to the tip side with respect to the protrusion 44B1 (base end side of the developing blade 44), that is, the downstream side in the rotation direction of the developing roller 42 is a straight portion 44B3 which is formed in a planar shape and faces the developing roller 42 through a predetermined space.

Here, the height of the step between the protrusion 44B1 and the opposing portion 44B2 (height of the protrusion 44B1), that is, the distance between the pressure contact surface of the developing blade 44 which is in pressure contact with the developing roller 42 and the opposing surface at a distance from the developing roller 42 as compared to the pressure contact surface is denoted by H (mm). Further, the length of the opposing portion 44B2 in the lateral direction is taken as L (mm). The contact radius of the protrusion 44B1 of the developing blade 44 that is in contact with the developing roller 42, that is, the curvature radius of a circular arc forming the tip surface of the protrusion 44B1, when viewing the cross section perpendicular to the rotation axis of the developing roller 42, that is, the cross section shown in FIGS. 3A and 3B, is denoted by R (mm). The curvature radius R is preferably at least 1.00 mm so that the developing blade 44 be in stable contact with the developing roller 42 over a certain contact width.

Figure 3B:
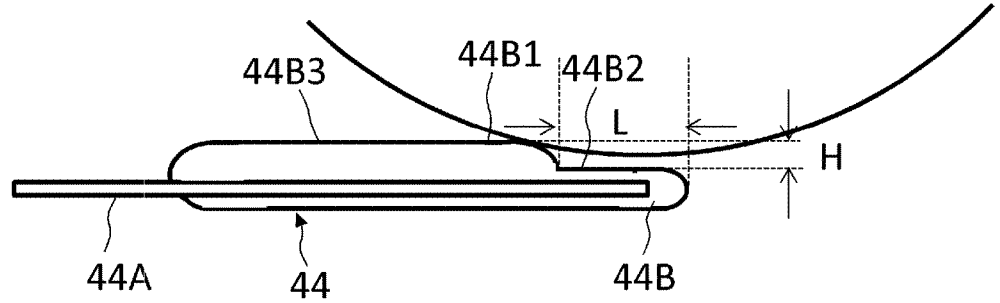

FIG. 3B is a schematic cross-sectional view for explaining the shape of the developing blade in a variation example of the present example. As long as the configuration of the developing blade 44 using the present invention has the above-described opposing portion 44B2, other portions may be configured such as shown in FIG. 3B.

Thus, in Example 1, as shown in FIG. 3A, the straight portion 44B3 is lower than the protrusion 44B1 (is at a distance from the developing roller 42). By contrast, in the variation example shown in FIG. 3B, the straight portion 44B3 is formed to have the same height as the protrusion 44B1.

<Effect on Dripping>

In the present example, a test to determine the presence/absence of dripping was performed by using the developing blade 44 with the protrusion height H=0.05 mm and the opposing portion length L=1.0 mm. The lower limit of the contact pressure X of the developing blade 44 of the present example with respect to the developing roller 42 was set to X=15 gf/cm. Further, in the test, the potential difference Δ between the developing bias applied to the developing roller 42 and the supply bias applied to the supply roller 43 was −100 V to −220 V. Here, the potential difference Δ is a value obtained by subtracting the value of the developing bias from the value of the supply bias, and the negative potential difference Δ means that the absolute value of the supply bias is greater than that of the developing bias. For example, when the developing bias V=−300 V and the supply bias V=−400 V, the potential difference Δ=−100 V and a biasing force that directs the toner of negative polarity from the supply roller 43 to the developing roller 42 is generated between the supply roller 43 and the developing roller 42.

As a condition of the durability test, 10,000 sheets with images in which a horizontal line periodically appeared with an image printing rate of 0.5% were intermittently printed in an evaluation environment of 15.0° C. and 10% RH. The intermittent printing, as referred to herein, means that next printing is performed after a standby state following the previous printing. The occurrence of "dripping" in this evaluation refers to a state in which the toner is not held on the developing roller and the toner is falling on the developing blade at a portion downstream of the position where the developing roller is in contact with the developing blade. Where image formation is continued in the state in which dripping has occurred, contamination develops inside of the image forming apparatus main body and on the recording material and image quality deteriorates.

<Test Results>

The evaluation results are shown in Table 1. In the table, ○ indicates that toner dripping has not occurred, and x indicates that toner dripping has occurred.

TABLE 1

| Δ(V) | Dripping |
|---|---|
| −100 | ○ |
| −160 | ○ |
| −180 | ○ |
| −200 | ○ |
| −220 | X |

As shown in Table 1, the dripping did not occur at a potential difference between the developing bias and the supply bias of Δ=−100, −160, −180, and −200 (V) and occurred at Δ=−220 (V). Therefore, in the apparatus configuration using the specific developing blade of the present example, in order to avoid the occurrence of dripping, it is at least necessary that the potential difference Δ between the developing bias and the supply bias satisfy the relationship Δ≥−200 (V) when the biases are set.

As explained hereinabove, one specific feature of the present example is that the developing device in which the developing roller and the toner supply roller rotate so as to move in the same direction at the contact region thereof, the developing blade is provided with the following configuration. Thus, a protrusion that protrudes toward the developing roller is provided, at a distance from the free end tip, in an opposing portion of the developing blade that faces the developing roller close to the end portion of the free end, and a step is formed by the pressure contact surface of the developing blade that is in pressure contact with the developing roller and the opposing surface that faces the developing roller at a distance therefrom. Another specific feature is that bias application is controlled such that the potential difference Δ between the developing bias and the supply bias is Δ≥−200 (V). Since the dripping is a problem caused by the toner supply capability of the supply roller exceeding the regulating force of the developing blade, the occurrence of dripping can be suppressed by adjusting the potential difference Δ.

Example 2

Example 2 of the present invention will be explained hereinbelow. In the present example, the settings of the height H of the protrusion and the length L of the opposing portion of the developing blade 44 and the contact pressure X of the developing blade 44 with respect to the developing roller 42 are different from those of Example 1. Other features of Example 2 are the same as those of Example 1, and redundant explanation thereof is herein omitted. Matters which are not described in Example 2 are the same as those of Example 1.

<Shape Range of Developing Blade>

The shape range of the developing blade 44 in Example 2 will be explained hereinbelow. Developing blades 44 in which parameters of the developing blade 44, namely, the height H of the protrusion and the length L of the opposing portion were changed, were prepared and the following test was performed. As a comparison example, the developing blade 44 without the protrusion was used. The test was performed by setting the upper limit of the contact pressure X of the developing blade 44 with respect to the developing roller 42 to X=60 gf/cm and the potential difference Δ between the developing bias and the supply bias to Δ=−200 (V).

(1) Evaluation of Density Stability at Leading End of Solid Image

As a method for evaluating image defects (development ghosts), the decrease in image density in the case of solid high printing rate was measured to evaluate the density stability at the leading end of a solid image. The evaluation was performed after allowing the image forming apparatus to stand for 1 day under an evaluation environment of 15.0° C. and 10% RH to adjust the apparatus to the environment. In the print evaluation test, first, a solid white image which does not consume the toner was printed, and then a solid black image was continuously outputted and the evaluation was performed from the difference in density between the output leading end of the solid black image and the solid black image after one rotation of the developing roller. The measurement was performed using Spectrodensitometer 500 manufactured by X-Rite Inc. In the printing test and image evaluation, a single-color (black) image was outputted.

A: the difference in density between the leading end of the recording material and after one rotation of the developing roller in a solid image is less than 0.02;

B: the difference in density between the leading end of the recording material and after one rotation of the developing roller in a solid image is 0.02 to less than 0.04; and C: the difference in density between the leading end of the recording material and after one rotation of the developing roller in a solid image is at least 0.04.

(2) Presence/Absence of Dripping

After the evaluation described in (1) hereinabove, the image forming apparatus which underwent the durability test was disassembled, and it was investigated and evaluated whether or not the toner dropped on the developing blade. As a condition of the durability test, 10,000 sheet with images in which a horizontal line periodically appeared with an image printing rate of 0.5% were intermittently printed in an evaluation environment of 15.0° C. and 10% RH.

<Test Results>

The evaluation results are shown in Table 2.

TABLE 2

| | Protrusion height H (mm) | Length L (mm) of opposing portion | Density stability at leading end | Toner dripping |
|---|---|---|---|---|
| Comparative Example | 0 | 0 | C | ○ |
| Example 2 | 0.05 | 0.15 | A | ○ |
| | | 0.30 | A | ○ |
| | | 1.0 | A | ○ |
| | | 1.5 | A | X |
| | 0.1 | 0.15 | A | ○ |
| | | 0.30 | A | ○ |
| | | 1.0 | A | ○ |
| | 0.3 | 0.15 | B | ○ |
| | | 0.30 | B | ○ |
| | | 1.0 | B | ○ |
| | 0.35 | 0.15 | C | ○ |

Initially, the results of the comparative example will be described. In the comparative example, the developing blade configured to have no protruding shape on the toner regulating surface is used. In the configuration of the comparative example, there is a difference between the toner charge quantity (charge amount) on the developing roller after solid white printing and after solid black printing, and density stability at the leading end of the recording material (leading end of the image) is difficult to ensure.

The results obtained in the present example will be described below. In the present example, the developing blade 44 is used which is configured to have a protruding shape on the toner regulating surface, as shown in FIGS. 3A and 3B. The test was performed by changing the height H of the protrusion from 0.05 mm to 0.35 mm and the length L of the opposing portion from 0.15 mm to 1.5 mm. When the height H of the protrusion was 0.05 mm to 0.3 mm, density stability at the leading end could be ensured with the length L of the opposing portion being from 0.15 mm to 1.5 mm. However when the height of the protrusion was H=0.05 mm and the length of the opposing portion was L=1.5 mm, dipping occurred at Δ=−200 (V). When the height of the protrusion was H=0.35 mm, although no dripping occurred when the length of the opposing portion was L=0.15 mm, density stability at the leading end could not be ensured. Therefore, it was found that a range of the height of the protrusion of H=0.05 mm to 0.3 mm and a range of the length of the opposing portion of L=0.15 mm to 1.0 mm are suitable for the shape of the developing blade 44. Furthermore, the more preferred ranges of the height of the protrusion of H=0.05 mm to 0.1 mm and the length of the opposing portion of L=0.15 mm to 1.0 mm are optimal because density stability at the leading end is good and no dripping occurs.

<Effect on Dripping>

Figure 4:
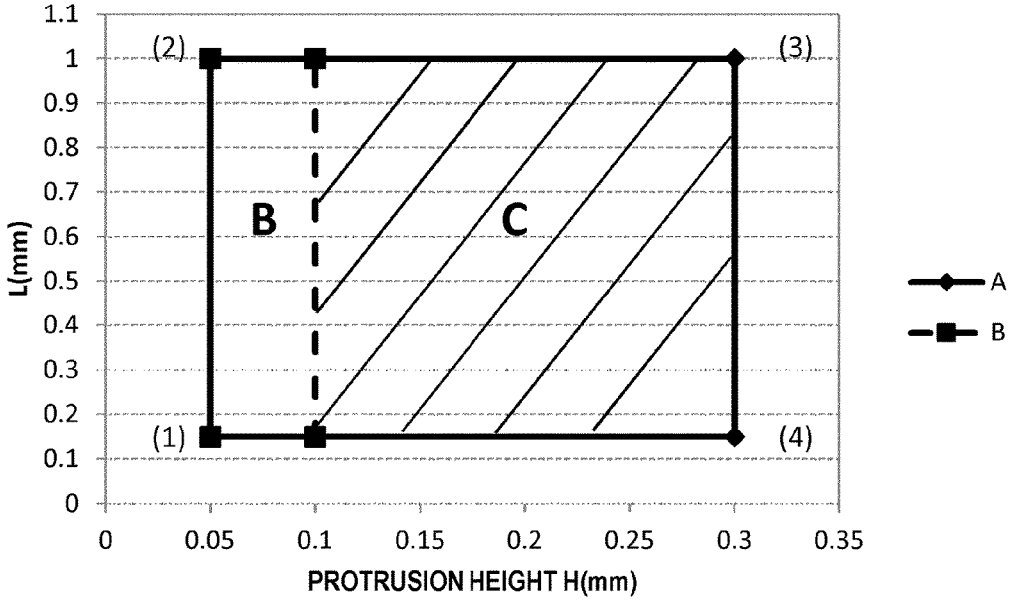
FIG. 4 is an explanatory drawing illustrating the shape range of the developing blade in Examples 2, 3, and 4.

The effect of the present example on dripping will be explained hereinbelow in greater detail with reference to FIG. 4 and Table 3. FIG. 4 illustrates the shape range of the developing blade 44. In the present test, four types of developing blade in a region A ((1) H=0.05, L=0.15; (2) H=0.05, L=1.0; (3) H=0.3, L=1.0; and (4) H=0.3, L=0.15) were used. Table 3 shows the evaluation results of determining the dripping by using the various blades. The determination of dripping was performed by intermittently printing 10,000 sheets with images, in which a horizontal line periodically appeared with an image printing rate of 0.5%, at a temperature of 15° C. and a humidity of 10%, which represent a low-temperature and low-humidity environment, and changing the potential difference Δ applied to the supply roller 43 with respect to the developing roller 42.

<Test Results>

The test results are shown in Table 3.

TABLE 3

| ∠(V) | (1) H = 0.05 L = 0.15 | (2) H = 0.05 L = 1.0 | (3) H = 0.3 L = 1.0 | (4) H = 0.3 L = 0.15 |
|---|---|---|---|---|
| −200 | ○ | ○ | ○ | ○ |
| −300 | ○ | ○ | ○ | ○ |
| −400 | ○ | ○ | ○ | ○ |
| −500 | ○ | X | ○ | ○ |
| −600 | ○ | X | X | ○ |
| −700 | ○ | X | X | ○ |
| −800 | X | X | X | ○ |

The evaluation results are explained hereinbelow. Table 3 shows the test results obtained in examining the relationship between the potential difference Δ between the developing bias and the supply bias and the dripping for four types of the developing blade 44. As shown in Table 3, although the potential difference Δ at which dripping occurs differs depending on the shape of the developing blade 44, in the present example in which the upper limit of the contact pressure on the developing blade 44 was set, the occurrence of dripping can be prevented when at least the relationship of $$\Delta \geq -400 \text{ (V)}$$

can be satisfied.

As explained hereinabove, the dripping is a problem caused by the toner supply capability of the supply roller exceeding the regulating force of the developing blade. According to the present example, the dripping can be avoided by appropriately adjusting the potential difference Δ between the developing bias and the supply bias and the contact pressure X of the developing blade.

Examples 3 and 4

Examples 3 and 4 of the present invention will be explained hereinbelow. In Examples 3 and 4, the height H of the protrusion and the length L of the opposing portion of the developing blade 44 are different from those of Example 1 and the contact pressure X of the developing blade 44 is different from that of Example 2. Other features of Examples 3 and 4 are the same as those of Example 1, and redundant explanation thereof is herein omitted. Matters which are not described in Examples 3 and 4 are the same as those of Example 1.

As shown in FIG. 4, the developing blade 44 of Example 3 is of a region B type and has the height H of the protrusion of 0.05 mm to 0.1 mm and the length L of the opposing portion of 0.15 mm to 1.0 mm. Further, the developing blade 44 of Example 4 is of a region C type, which is obtained by removing the region B from the region A (hatched region in the drawing), and has the height H of the protrusion of 0.1 mm to 0.3 mm and the length L of the opposing portion of 0.15 mm to 1.0 mm.

<Effect on Dripping>

Figure 5A:
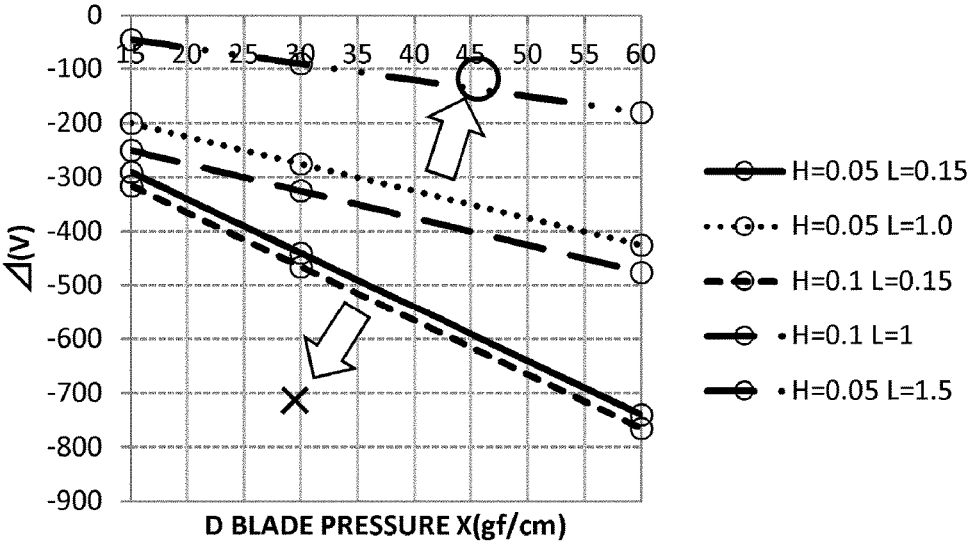
FIGS. 5A and 5B are explanatory drawings illustrating the relationship between the potential difference $\Delta$, blade pressure X, and occurrence of dripping.
Figure 5B:
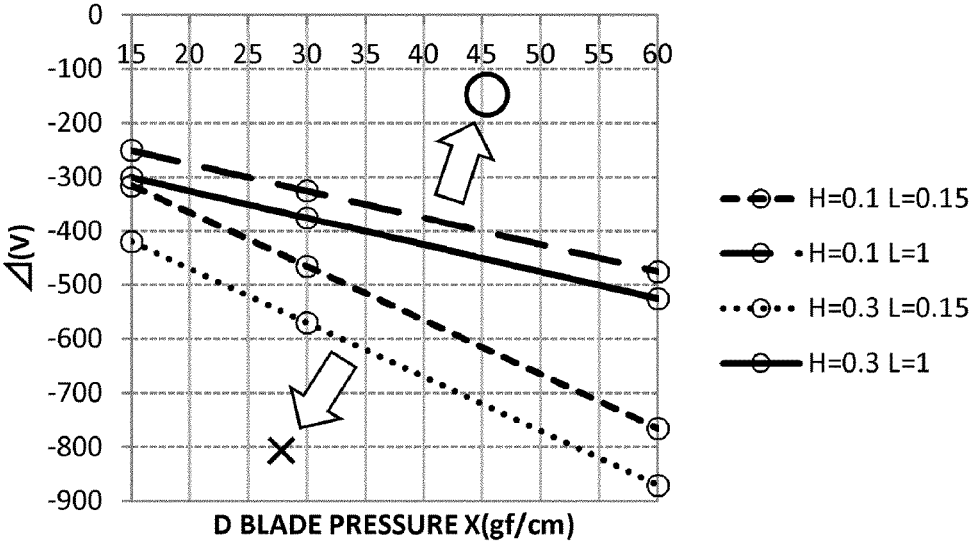

FIGS. 5A and 5B show the test results obtained in examining the relationship between the potential difference Δ between the developing bias and the supply bias and the contact pressure X of the developing blade by using various blades for which the height H of the protrusion and the length L of the opposing portion were set to different values. The evaluation results relating to dripping will be explained with reference to FIGS. 5A and 5B. The determination of dripping was performed by intermittently printing 10,000 sheets with images, in which a horizontal line periodically appeared with an image printing rate of 0.5%, at a temperature of 15° C. and a humidity of 10% which represent a low-temperature and low-humidity environment. FIG. 5A shows the results relating to the region B shown in FIG. 4, and FIG. 5B shows the results relating to the region C shown in FIG. 4. In the graphs shown in FIGS. 5A and 5B, the reference symbol ○ indicates that dripping has not occurred, and the reference symbol x indicates that dripping has occurred. As shown by the graphs in FIGS. 5A and 5B, the dripping did not occur above a line connecting the reference symbols ○ in each blade (referred to hereinbelow as "boundary line"), and the dripping occurred below the boundary line. For comparison, the results obtained with H=0.05 and L=1.5 are also shown in FIG. 5A.

The dripping is a problem caused by the toner supply capability of the supply roller 43 exceeding the regulating force of the developing blade 44. Therefore, the dripping depends on the contact pressure X of the developing blade 44 with respect to the developing roller 42, and the dripping occurs when the contact pressure X is low and does not occur when the contact pressure is high. As a result, the boundary line for avoiding the dripping is a boundary line rising leftward as shown in the graphs in FIGS. 5A and 5B. Further, where the height of the protrusion is increased from 0.05 mm to 0.1 mm, the boundary line shifts downward. This is because the space between the protrusion and the developing roller 42 on the upstream side of the protrusion in the rotation direction of the developing roller 42 becomes larger, and therefore, the toner can be accumulated in this space. Further, where the length L of the opposing portion increases from 0.15 mm to 1.0 mm, the boundary line shifts upward. This is because, the toner supplied from the supply roller is easily taken in by the opposing portion of the developing blade.

As mentioned hereinabove, the dripping depends on the contact pressure X of the developing blade 44 with respect to the developing roller 42. Therefore, according to the results shown in FIG. 5A, in Example 3 representing the region B, the dripping does not occur in any of the developing blades 44 above the boundary line in the developing blades 44 with at least H=0.05 and L=1.0. Based on the test results, the boundary line of such developing blades 44 can be represented by $$\Delta=-5*X-125.$$

Therefore, the occurrence of dripping can be avoided in the shape range ($0.05\leq H<0.1$, $0.15\leq L\leq 1.0$) and blade pressure range ($15\leq X\leq 60$) of the developing blade 44 of Example 3, provided that at least the relationship of $$\Delta\geq-5*X-125$$

is satisfied.

Further, according to the results shown in FIG. 5B, in Example 4 representing the region C, the dripping does not occur in any of the developing blades 44 above the boundary line in the developing blades 44 with at least H=0.1 and L=1.0. Based on the test results, the boundary line of such developing blades 44 can be represented by $$\Delta=-5*X-175.$$

Therefore, the occurrence of dripping can be avoided in the shape range ($0.1\leq H\leq 0.3$, $0.15\leq L\leq 1.0$) and blade pressure range ($15\leq X\leq 60$) of the developing blade 44 of Example 4, provided that at least the relationship of $$\Delta\geq-5*X-175$$

is satisfied.

As explained hereinabove, since the dripping is a problem caused by the toner supply capability of the supply roller exceeding the regulating force of the developing blade, the dripping can be avoided by adjusting the potential difference Δ between the developing bias and the supply bias and the contact pressure X of the developing blade.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-069388, filed Mar. 30, 2016, which is hereby incorporated by reference herein in its entirety.

What is claimed is:

1. A developing device for use in an image forming apparatus, the developing device comprising:

a frame that accommodates a developer;

a developer carrying member that is rotatably provided in an opening of the frame and carries and transports the developer;

a supply member that supplies the developer to the developer carrying member, the supply member being in contact with the developer carrying member and being provided rotatably so as to move in the same direction with respect to the rotating developer carrying member at a contact region thereof;

a regulating member that is blade-shaped, one end of the regulating member being fixed to the frame, and a distal end of the regulating member, which is a free end extending in a direction opposite to a rotation direction of the developer carrying member, being in contact with the developer carrying member;

a developing bias application portion for applying a developing bias to the developer carrying member; and a supply bias application portion for applying a supply bias to the supply member, the regulating member comprising, an opposing portion that faces the developer carrying member, and a protrusion that extends from the opposing portion and protrudes toward the developer carrying member;

wherein the opposing portion comprises an opposing surface that faces the developer carrying member at a distal end side of the protrusion, and wherein, when a potential difference between the supply bias and the developing bias, which is obtained by subtracting the developing bias from the supply bias, is denoted by Δ(V), a contact pressure of the regulating member with respect to the developer carrying member is denoted by X (gf/cm), and a height of the protrusion from the opposing surface is denoted by H (mm) and a length of the opposing surface in the rotation direction of the developer carrying member is denoted by L (mm), when viewing a cross section perpendicular to a rotation axis of the developer carrying member, $0.05 \leq H \leq 0.1$, $0.15 \leq L \leq 1.0$, and $15 \leq X \leq 60$ are established, and at least the following relationship is satisfied:

$$\Delta \geq -5*X-125.$$

2. The developing device according to claim 1, wherein a position at which the protrusion of the regulating member is in contact with the developer carrying member is below a rotation center of the developer carrying member and is between the rotation center of the developer carrying member and a rotation center of the supply member in a horizontal direction.

3. The developing device according to claim 1, wherein the regulating member has an elastic support member and a resin layer that is provided on a surface of the support member and is in contact with the developer carrying member; and the protrusion is molded integrally as part of the resin layer.

4. The developing device according to claim 1, wherein the developer is a nonmagnetic mono-component toner.

5. A process cartridge that can be detachably attached to an apparatus main body of an image forming apparatus, the process cartridge comprising:

the developing device according to claim 1; and an image bearing member on which a latent image that is to be developed by the developing device is formed.

6. An image forming apparatus that forms an image on a recording material, the image forming apparatus comprising:

the developing device according to claim 1; and an image bearing member on which a latent image that is to be developed by the developing device is formed, wherein a developer image which has been formed on the image bearing member by the development of the latent image is transferred to a recording material.

7. The image forming apparatus according to claim 6, further comprising an intermediate transfer member which is disposed above the image bearing member, and onto which the developer image formed on the image bearing member is transferred, and moreover which transfers the transferred developer image to the recording material.

8. A developing device for use in an image forming apparatus, the developing device comprising:

a frame that accommodates a developer;

a developer carrying member that is rotatably provided in an opening of the frame and carries and transports the developer;

a supply member that supplies the developer to the developer carrying member, the supply member being in contact with the developer carrying member and being provided rotatably so as to move in the same direction with respect to the rotating developer carrying member at a contact region thereof;

a regulating member that is blade-shaped, one end of the regulating member being fixed to the frame, and a distal end of the regulating member, which is a free end extending in a direction opposite to a rotation direction of the developer carrying member, being in contact with the developer carrying member;

a developing bias application portion for applying a developing bias to the developer carrying member; and a supply bias application portion for applying a supply bias to the supply member, the regulating member comprising;

an opposing portion that faces the developer carrying member, and a protrusion that is provided on the opposing portion away from the distal end, and protrudes toward the developer carrying member; and wherein a potential difference between the supply bias and the developing bias, which is obtained by subtracting the developing bias from the supply bias, is denoted by $\Delta(V)$, at least the following relationship is satisfied:

$$\Delta \geq -200.$$

9. The developing device according to claim 8, wherein a position at which the protrusion of the regulating member is in contact with the developer carrying member is below a rotation center of the developer carrying member and is between the rotation center of the developer carrying member and a rotation center of the supply member in a horizontal direction.

10. The developing device according to claim 8, wherein the regulating member has an elastic support member and a resin layer that is provided on a surface of the support member and is in contact with the developer carrying member; and the protrusion is molded integrally as part of the resin layer.

11. The developing device according to claim 8, wherein the developer is a nonmagnetic mono-component toner.

12. A process cartridge that can be detachably attached to an apparatus main body of an image forming apparatus, the process cartridge comprising:

the developing device according to claim 8; and an image bearing member on which a latent image that is to be developed by the developing device is formed.

13. An image forming apparatus that forms an image on a recording material, the image forming apparatus comprising:

the developing device according to claim 8; and an image bearing member on which a latent image that is to be developed by the developing device is formed, wherein a developer image which has been formed on the image bearing member by the development of the latent image is transferred to the recording material.

14. The image forming apparatus according to claim 13, further comprising an intermediate transfer member which is disposed above the image bearing member, and onto which the developer image formed on the image bearing member is transferred, and moreover which transfers the transferred developer image to the recording material.

15. A developing device for use in an image forming apparatus, the developing device comprising:

a frame that accommodates a developer;

a developer carrying member that is rotatably provided in an opening of the frame and carries and transports the developer;

a supply member that supplies the developer to the developer carrying member, the supply member being in contact with the developer carrying member and being provided rotatably so as to move in the same direction with respect to the rotating developer carrying member at a contact region thereof;

a regulating member that is blade-shaped, one end of the regulating member being fixed to the frame, and a distal end of the regulating member, which is a free end extending in a direction opposite to a rotation direction of the developer carrying member, being in contact with the developer carrying member;

a developing bias application portion for applying a developing bias to the developer carrying member; and a supply bias application portion for applying a supply bias to the supply member, the regulating member comprising, an opposing portion that faces the developer carrying member, and a protrusion extends from the opposing portion and protrudes toward the developer carrying member;

wherein the opposing portion comprises an opposing surface that faces the developer carrying member at a distal end side of the protrusion, and wherein a potential difference between the supply bias and the developing bias, which is obtained by subtracting the developing bias from the supply bias, is denoted by Δ(V), a contact pressure of the regulating member with respect to the developer carrying member is denoted by X (gf/cm), and a height of the protrusion from the opposing surface is denoted by H (mm) and a length of the opposing surface in the rotation direction of the developer carrying member is denoted by L (mm), when viewing a cross section perpendicular to a rotation axis of the developer carrying member, $0.1 \leq H \leq 0.3$, $0.15 \leq L \leq 1.0$, and $15 \leq X \leq 60$ are established, and at least the following relationship is satisfied:

$$\Delta \geq -5*X-175.$$

16. The developing device according to claim 15, wherein a position at which the protrusion of the regulating member is in contact with the developer carrying member is below a rotation center of the developer carrying member and is between the rotation center of the developer carrying member and a rotation center of the supply member in a horizontal direction.

17. The developing device according to claim 15, wherein the regulating member has an elastic support member and a resin layer that is provided on a surface of the support member and is in contact with the developer carrying member; and the protrusion is molded integrally as part of the resin layer.

18. The developing device according to claim 15, wherein the developer is a nonmagnetic mono-component toner.

19. A process cartridge that can be detachably attached to an apparatus main body of an image forming apparatus, the process cartridge comprising:

the developing device according to claim 15; and an image bearing member on which a latent image that is to be developed by the developing device is formed.

20. An image forming apparatus that forms an image on a recording material, the image forming apparatus comprising:

the developing device according to claim 15; and an image bearing member on which a latent image that is to be developed by the developing device is formed, wherein a developer image which has been formed on the image bearing member by the development of the latent image is transferred to the recording material.

21. The image forming apparatus according to claim 20, further comprising an intermediate transfer member which is disposed above the image bearing member, and onto which the developer image formed on the image bearing member is transferred, and moreover which transfers the transferred developer image to the recording material.

* * * * *